United States Patent [19]

Mizelle

[11] 4,339,834

[45] Jul. 20, 1982

[54] BOX SPRING ASSEMBLY WITH INTERLOCKED FORMED WIRE COMPONENTS AND METHOD OF ASSEMBLING SAME

[75] Inventor: Ned W. Mizelle, Lexington, Ky.

[73] Assignee: Hoover Universal, Inc., Ann Arbor, Mich.

[21] Appl. No.: 131,935

[22] Filed: Mar. 21, 1980

[51] Int. Cl.[3] ..... A47C 23/02; F16F 3/00

[52] U.S. Cl. ..... 5/255; 5/247; 5/267; 267/103; 267/107

[58] Field of Search ..... 5/247, 255, 260, 267, 5/476, 478; 267/103, 107

[56] References Cited

U.S. PATENT DOCUMENTS

| | | | |
|---|---|---|---|
| 2,773,543 | 12/1956 | Sandor | 267/107 |
| 3,248,745 | 5/1966 | Gunlock | 5/247 |
| 3,722,013 | 3/1973 | Surletta | 5/255 |
| 3,833,948 | 9/1974 | Surletta et al. | 5/247 |
| 3,852,838 | 12/1974 | Slominski et al. | 5/247 |
| 4,068,329 | 1/1978 | Gross et al. | 5/255 |
| 4,068,330 | 1/1978 | Rakow et al. | 5/267 |
| 4,101,993 | 7/1978 | Yates et al. | 5/267 |
| 4,129,908 | 12/1978 | Wagner | 5/247 |
| 4,218,790 | 8/1980 | Mizelle | 5/247 |
| 4,238,861 | 12/1980 | Mizelle | 5/255 |
| 4,253,208 | 3/1981 | Hancock et al. | 5/247 |

*Primary Examiner*—Victor N. Sakran

*Attorney, Agent, or Firm*—Olsen and Stephenson

[57] ABSTRACT

A box spring assembly which includes a generally rectangular frame, a plurality of upwardly extending wire springs mounted on the frame, and a wire grid supported on the upper ends of the springs so that the grid and springs cooperate to yieldably resist downwardly directed bedding loads. Each of the springs is formed at its upper end with an attaching portion that is structured so that it can be connected to the grid merely by moving it from an initial position to an interlocked position. This structure enables assembly of the grid and the springs without the requirement for the usual attaching clips.

11 Claims, 7 Drawing Figures

BOX SPRING ASSEMBLY WITH INTERLOCKED FORMED WIRE COMPONENTS AND METHOD OF ASSEMBLING SAME

BACKGROUND OF THE INVENTION

This invention relates generally to mattress foundation structures and more particularly to a box spring assembly of a type which utilizes non-coil springs. The spring in the present box spring assembly is constructed so that it can be assembled with the grid without clips, thus simplifying assembly and reducing costs.

It is an object of the present invention, therefore, to provide an improved box spring assembly, an improved method of assembling a box spring, and improved springs that can be advantageously employed in box springs.

SUMMARY OF THE INVENTION

The box spring assembly of this invention consists of a rectangular frame having side rails, end rails, and a plurality of cross rails that are generally parallel and are substantially perpendicular to the side rails. The box spring assembly also includes a rectangular wire grid that forms a mattress support deck positioned above the frame and a plurality of wire springs that are mounted on the cross rails and connected to the deck so as to yieldably resist downwardly directed bedding loads.

Each of the springs is formed of spring steel wire and has a vertically yieldable portion secured at the lower end to a cross rail and terminates at the upper end in a deck-attaching portion, each deck-attaching portion including a pair of generally parallel spaced wire sections and a connecting wire section integral with and extending diagonally between the spaced wire sections. Each attaching portion is located so that a mid portion of the connecting wire section therein is positioned on top of the intersection of a pair of intersecting wires in the deck and the parallel wire sections extend crosswise of and engage the underside of one of the wires on opposite sides of the intersection so as to clamp the spring to the deck and utilize the spring in the deck and spring wires to maintain the clamp.

The arrangement obviates any necessity for the usual clips to secure the springs to the deck.

Some of the grid wires can be notched to recline the springs and provide against relative movement of grid and springs. This may be desirable in the case of grids in which the wires are not welded to each other. In the case of welded wire grids, commonly used in the prior art, notching of one of the wires of the grid is optional. Notching of the other wire is obviated by the weld. The spring of this invention thus has the ability to lock into a welded wire grid.

In one embodiment of the invention, the springs are formed so that each one is of balanced construction having upright columns which terminate at their lower ends in torsion bar components that yield in a vertical direction. This allows the columns to bottom on the cross rails and thus limit deck deflection.

In another embodiment of the invention, the springs are made up totally of torsion bar components thus providing practically limitless deflection of the deck. These latter springs are structured so that they can be manufactured in pairs and then separated to form right and left hand versions of the springs.

Further objects, features, and advantages of this invention will become apparent from a consideration from the following description, the appended claims, and the accompanying drawing in which:

Figure 1:
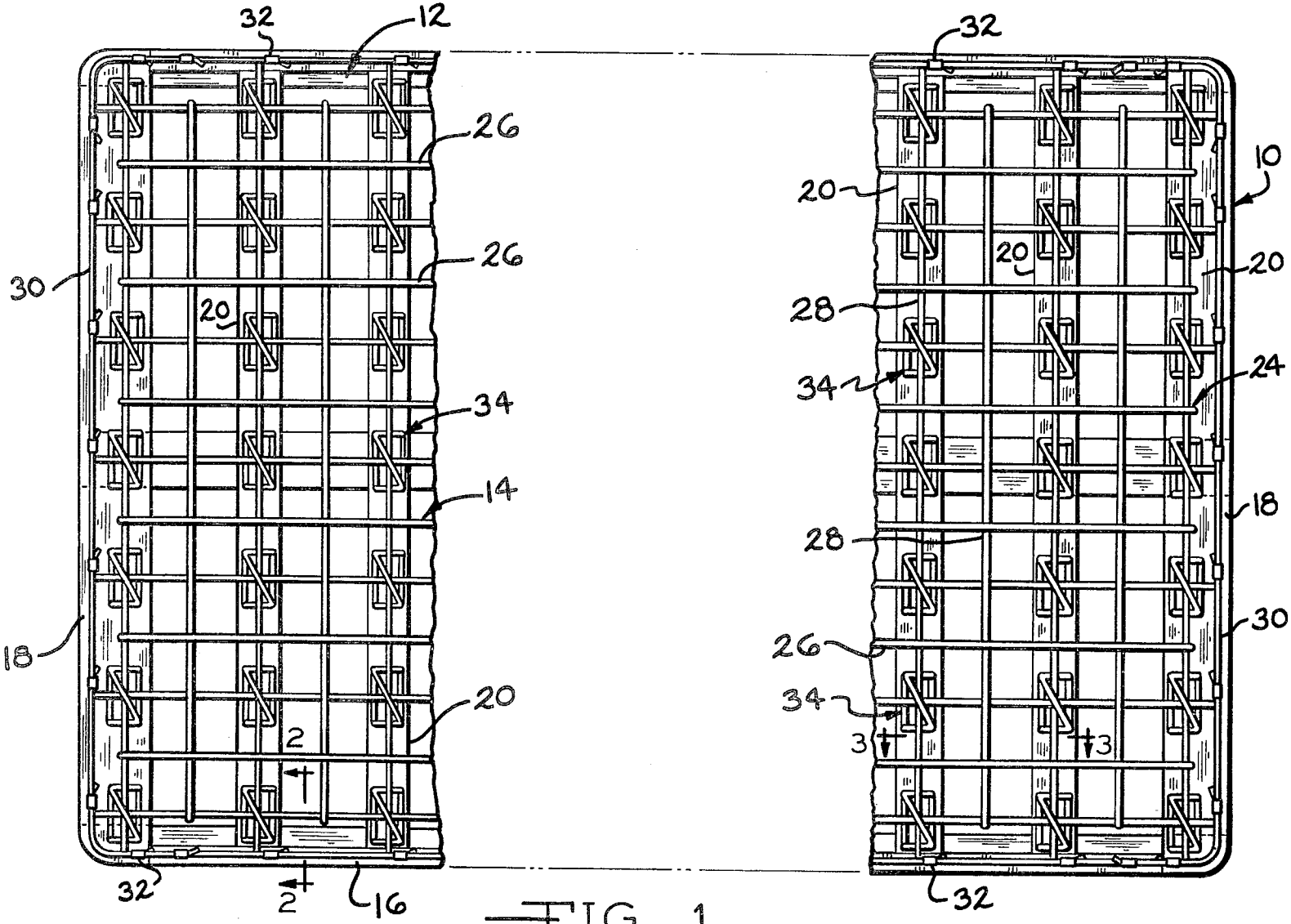
FIG. 1 is a plan view of the box spring assembly of this invention with the middle portion of the spring assembly being broken away for ease of illustration.

With reference to the drawing, the spring assembly of this invention, indicated generally at 10, is illustrated in FIG. 1 as consisting of a generally rectangular, horizontally disposed frame 12, usually formed of wood, and a wire spring assemblage 14 mounted on the top side of the frame 12. The frame 12 has side rails 16, end rails 18, and cross rails 20 which are secured to and extend between the side rails 16.

The spring assemblage 14 includes a horizontally disposed wire grid 24 which consists of a plurality of substantially straight wires that are arranged criss-cross fashion, some of the wires extending lengthwise of the frame 12 and being referred to hereinafter as "lengthwise wires 26" and some of the wires extending crosswise of the frame 12 and being hereinafter referred to as "crosswise wires 28". The grid 24 also includes a rectangular border wire 30 secured by clips 32 to some of the lengthwise wires 26 and some of the crosswise wires 28. The border wire 30 is of substantially the same size and shape as the frame 12.

The wire grid 24 forms a mattress support deck disposed in a horizontal plane at a predetermined distance above the frame 12. A plurality of support springs 34, arranged in a regular pattern on the frame 12, yieldably support the deck 24 in this position above the frame 12 for yieldable movement toward the frame 12 to accommodate bedding loads, namely, the mattress and mattress occupants.

Figure 2:
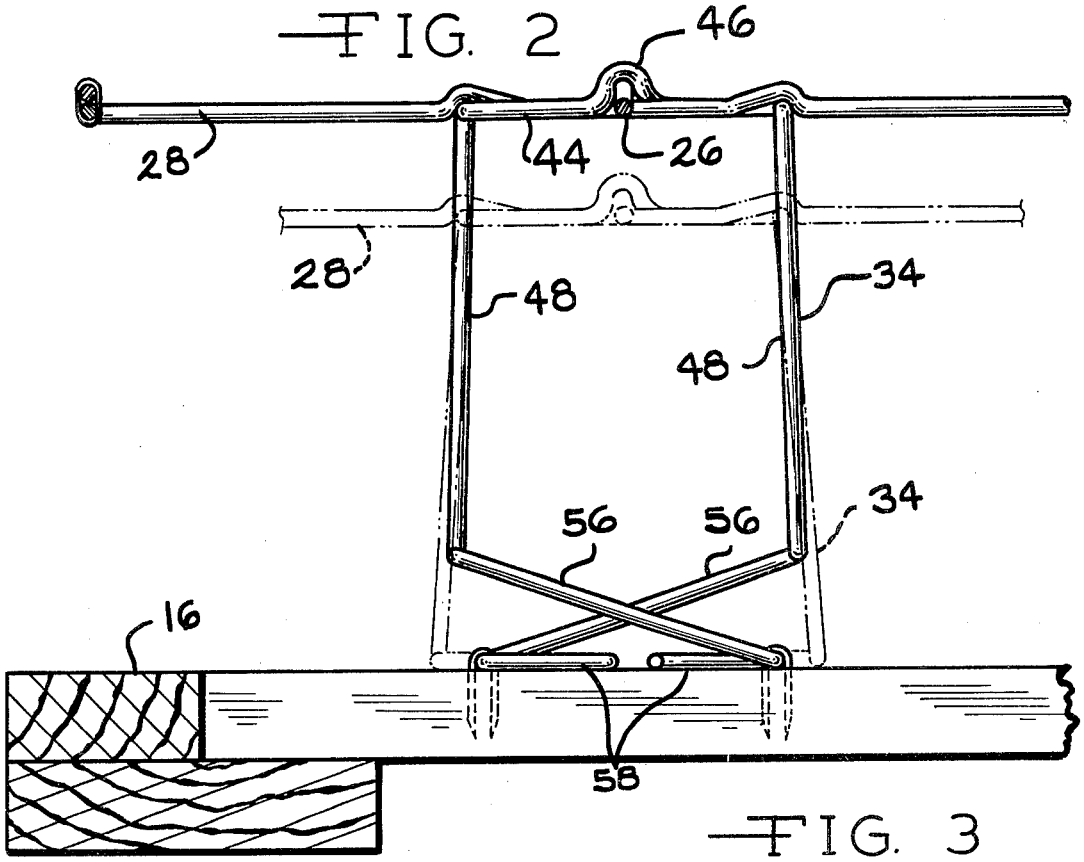
FIG. 2 is an enlarged fragmentary detail sectional view of a portion of the box spring assembly of this invention, as viewed from substantially the line 2—2 in FIG. 1, illustrating the spring component in the assembly and showing the spring in a deflected position in broken lines.
Figure 3:
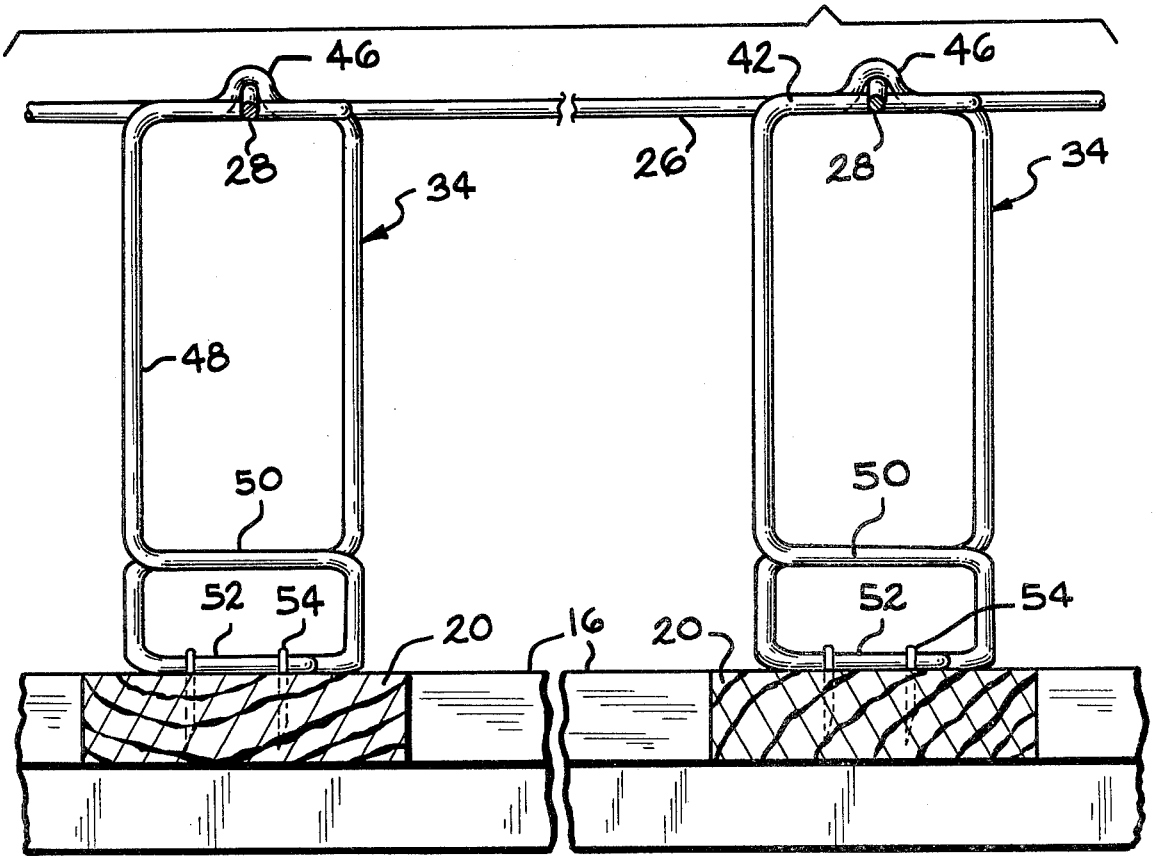
FIG. 3 is an enlarged fragmentary detail sectional view of a portion of the box spring assembly of this invention as seen from substantially the line 3—3 in FIG. 1, showing a pair of side-by-side spring components in the box spring assembly.
Figure 4:
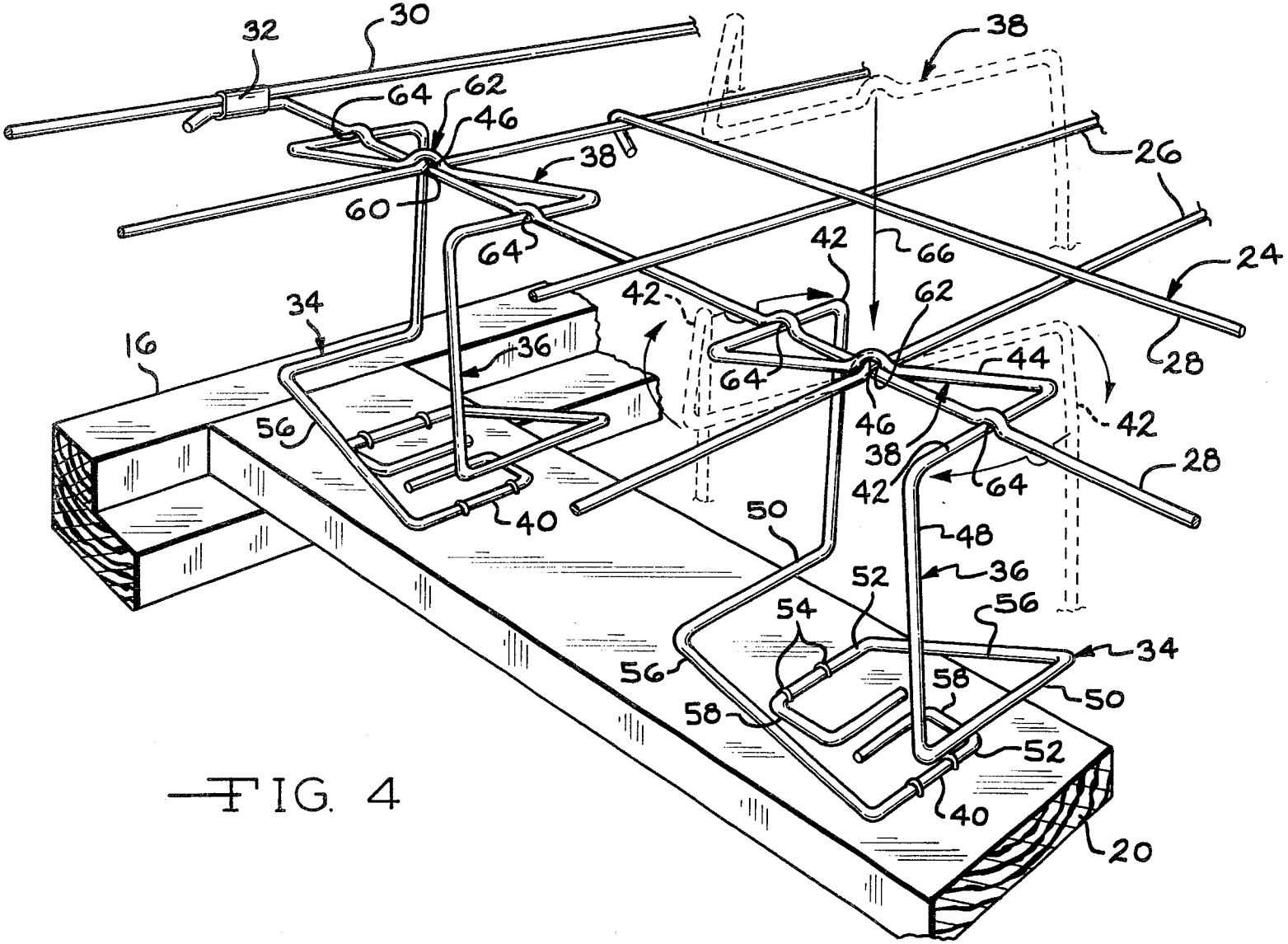
FIG. 4 is a fragmentary perspective view of a portion of the box spring assembly of this invention, illustrating in broken lines the successive steps that are performed in the assembly of the springs with the wire deck and the supporting frame in the method of assembling the box spring assembly of this invention.

As best appears in FIGS. 2–4, inclusive, the springs 34, which are formed of spring wire and provide uniform support for the entire area of the deck 24 (FIG. 1), each consists of an upright yieldable portion 36 formed integral at its upper end with an attaching portion 38 and secured at its lower end 40 to one of the frame cross rails 20. An attaching portion 38 consists of a pair of parallel spaced spring wire sections 42 which are connected by a diagonally extending connecting section 44. At its midpoint, the connecting section 44 is formed on its underside with a notch or notch-shape bend 46 for a purpose to appear presently.

The upright yieldable portion 36 consists a pair of upright columns 48 that are substantially straight and substantially vertical and are formed integral at their upper ends with the parallel wire sections 42. At their lower ends, the columns 48 are formed integral with transversely extending torsion bars 50 that are substantially parallel to and are disposed directly below the parallel wire sections 42. Torsion bars 52 at the lower end of the yieldable portion 36 are secured by staples 54 to the cross rail 20 and inclined connecting bars 56 extend between the torsion bars 50 and 52. The connecting bars 56 are reversely inclined relative to each other so as to be disposed entirely beneath the attaching portion 38. Conventional mounting feet 58 are formed integral with the torsion bars 52 and positioned in engagement with the cross rail 20 to provide for a stable mounting of the springs 34 on the frame 12.

As shown in FIG. 4, the lengthwise wire 26 is formed on its underside with a notch or notch-shape bend 60 at its juncture 62 with the crosswise wire 28 to stablize the juncture 62 against relative movement of the wires 26 and 28. Similarly, crosswise wire 28 is formed on its underside with notches or notch-shape bends 64 located to receive the parallel wire sections 42 in the spring 34.

One of the advantages of the spring 34 in the formed wire box spring assembly 10 is the ability to assemble the spring 34 with the deck 24 without the requirement for attaching clips. In the assembly of a spring 34 with the frame 12 and deck 24, the spring 34 is first disposed above the juncture 62 as shown in broken lines in FIG. 4 and then lowered to the lower broken line position shown in FIG. 4 in which the notch 46 in the connecting section 44 is located at the juncture 62 on the top side of the lengthwise wire 26. The parallel wire sections 42 are located in diagonally opposite quadrants of the four-quadrant space formed by the intersecting wires 26 and 28, as also shown in broken lines in FIG. 4. At this time, the torsion bars 52 at the lower end of the spring 34 are adjacent the cross rail 20.

The spring-attaching portion 38 is then rotated in a clockwise direction, when viewed from above, about a substantially vertical axis extending substantially through the juncture 62, such an axis being indicated by the arrow 66. During such rotation, the underside of the connecting section 44 at the notch 46 rotates on the top surface of the lengthwise wire 26 and the parallel sections 42 are moved into engagement with the underside of the cross wire 28 and into the notches 64 to positions in which the sections 42 are substantially centered with respect to the cross wire 28. The torsion bars 52 are then stapled to the top side of the cross rail 20.

It is to be noted that the crosswise wire 28 is then clamped between the parallel wire sections 42, which engage the underside of the wire 28, and the connecting wire section 38 which is engaged with the top side of lengthwise wire 26 that is in turn engaged with the top side of the crosswire 28. The result is a firm attachment of the attaching spring portion 38 to the wire grid 24 without the requirement for the conventional wrap-around clips, such as clips 32. The utilization of the notches 46, 60, and 64 insures that the grid components and the spring 34 will remain in the desired relative positions and the springiness in the wire which forms the grid 24 and the springs 34 insures the desired clamping of the spring attaching portion 38 to the grid 24.

Figure 5:
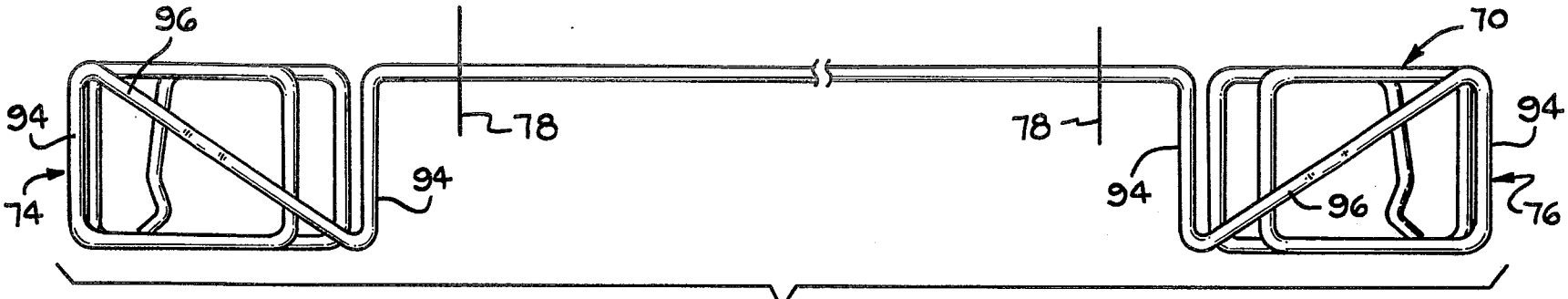
FIG. 5 is a plan view of a spring member that is useful in forming modified forms of the spring component in the box spring assembly of this invention.
Figure 7:
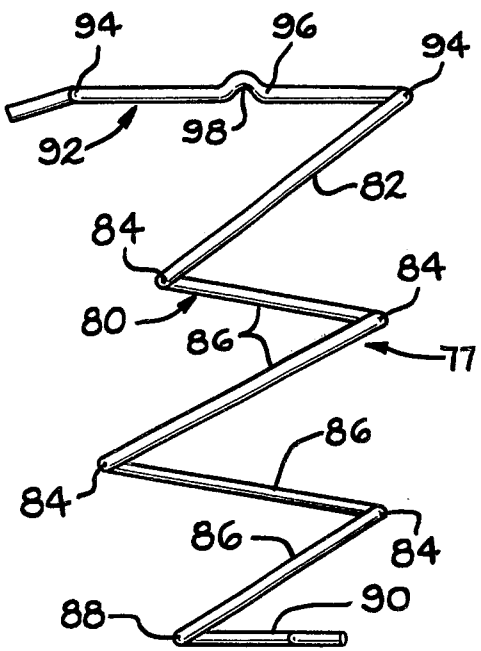
FIGS. 6 and 7 are elevational views of right and left hand forms of the modified form of the spring component that is formed from the spring member shown in FIG. 5.
Figure 6:
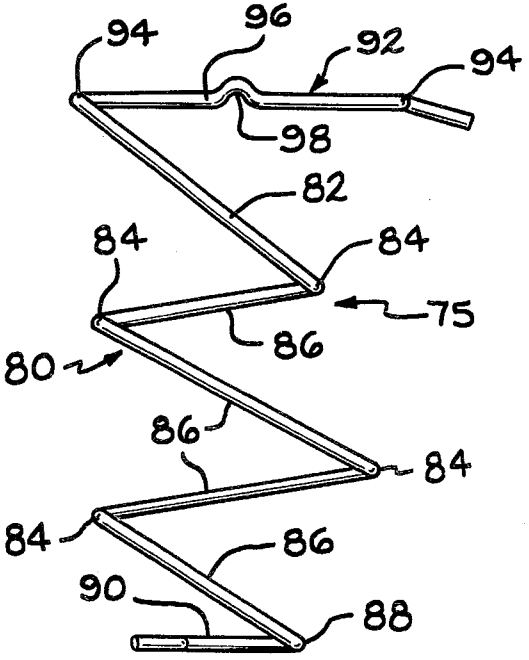

In FIG. 5, a spring member 70 is illustrated that includes a generally horizontal body portion 72 and end portions 74 and 76. The springs 75 and 77, shown in FIGS. 6 and 7, respectively, correspond to the end portions 74 and 76 of the spring 70 after the spring body portion 72 is cut along the lines indicated at 78 in FIG. 5. The springs 75 and 77 are right and left hand versions of each other and correspond substantially in construction to the spring end portion shown in U.S. Pat. No. 3,852,838 in that each of the springs 75 and 77 has a generally upright yieldable body portion 80 which consists of a downwardly and inwardly inclined upper connecting bar 82 and a series of alternating torsion bars 84 and inclined connecting bars 86, terminating at its bottom end in a torsion bar 88 adapted to be stapled to a cross rail 20 by staples like the staples 54 shown in FIG. 4 and having a mounting foot 90 like the mounting foot 58 shown in FIG. 4. The upper connecting bar 82 is formed integral with a spring attaching portion 92 that is identical to the attaching portion 38 in the spring 34 (FIG. 4). Each attaching portion 82 includes generally parallel, spaced-apart wire sections 94 and a connecting section 96 that extends diagonally between the sections 94. The mid portion of each connecting section 96 is formed on its underside with a notch or notch-shape bend 98, as shown in FIGS. 6 and 7.

The springs 75 and 77 can thus be used interchangably with the springs 34 in the box spring assembly 10. When so used, the springs 75 and 77 are alternated in the spring assemblage 14 to provide balanced resistance to bedding loads. The springs 75 and 77 are assembled with the wire grid 24 in the same manner that the springs 34 are assembled, as illustrated in FIG. 4 and described above.

From the above description, it is seen that this invention provides an improved formed wire box spring assembly 10 in which the supporting springs for the mattress-support deck 24 are readily assembled with the deck without any requirement for the usual wrap-around clips. The result is an improved box spring assembly which is easier to assemble, lighter in weight, and less expensive. Furthermore, in the preferred form of the invention, the springs 34 are limited deflection springs utilizing the upright columns 48 which, when the box spring assembly is fully loaded, bottom out on the cross rails 20, as shown in FIG. 2. This bottoming out feature provides the box spring assembly 10 with a desired rigidity and firmness in the fully loaded condition.

Each spring 34, during assembly with the grid 24, is movable from an initial position, shown in broken lines in FIG. 4, to an interlocked position with the grid 24, shown in solid lines in FIG. 4. In the interlocked position, the parallel wire sections 42 apply upwardly directed forces to the grid 24 and the connecting wire section 44 applies a downwardly directed force to the grid 24 at a location in between the upwardly directed forces. The result is a firm clamping or interlocking of the grid 24 to the springs 34. Since the attaching portions 92 of the springs 75 and 77 are identical to the attaching portion 38 of the spring 34, the springs 75 and 77 are similarly firmly interlocked with the grid 24 in the assembly 10.

What is claimed:

1. In a box spring assembly which includes a generally horizontal rectangular frame and a generally horizontal spring wire mattress support deck disposed a predetermined distance above said frame, said deck including a plurality of substantially straight wires arranged criss-cross fashion, some of said wires extending lengthwise of said frame and others of said wires extending crosswise of said frame; a plurality of deck support springs arranged in a regular pattern between said deck and said frame so as to yieldably support said deck on said frame, each of said springs including a vertically yieldable portion secured at the lower end to said frame and terminating at the upper end in a deck-attaching portion, each said deck-attaching portion including a pair of generally parallel spaced wire sections and a connecting wire section integral with and extending diagonally between said spaced wire sections, each said attaching portion being located so that a mid portion of the connecting wire section therein is at the juncture of a lengthwise wire with a crosswise wire in said deck and the parallel wire sections extend crosswise of one of said crosswise or lengthwise wires on opposite sides of said juncture, said parallel wire sections and said connecting wire section being located on opposite top and bottom sides of the deck wires at said juncture so as to clamp said spring to said deck.

2. The box spring assembly according to claim 1 wherein said connecting wire section is formed midway between the ends thereof with a downwardly facing notch-like bend into which a pair of criss-crossed deck wires project at the juncture of said pair of deck wires.

3. The box spring assembly according to claim 2 wherein said one of said crosswise or lengthwise wires is provided with a pair of downwardly facing notch-like bends in which said spaced parallel wire sections are positioned.

4. The box spring assembly according to claim 3 wherein said yieldable portion of said spring comprises a pair of upright members, first torsion bars at the lower ends of said members, second torsion bars engaged with and secured to said frame, and downwardly inclined connecting bars formed integral with and extending between said first and second torsion bars.

5. The box spring assembly according to claim 3 wherein said yieldable portion of said spring comprises a plurality of spaced torsion bars and inclined connecting bars formed integral with and extending between said torsion bars, the lowermost one of said torsion bars being engaged with and secured to said frame, and a frame-engaging foot integral with said lowermost torsion bar.

6. A box spring assembly comprising a rectangular frame having side rails, end rails, and a plurality of cross rails that are generally parallel to each other and are substantially perpendicular to said side rails, means forming a deck consisting of a plurality of substantially straight wires arranged criss-cross fashion above said frame, some of said wires extending crosswise of said frame at positions directly above said cross rails and others of said wires extending lengthwise of said frame, a plurality of wire springs mounted on said cross rails and connected to said deck so as to yieldably resist downwardly directed bedding loads applied to the deck, each of said springs including an upright vertically yieldable portion secured at the lower end to one of said cross rails and terminating at the upper end in a deck-attaching portion, each said deck-attaching portion including a pair of generally parallel spaced wire sections and a connecting wire section integral with and extending between said spaced wire sections, each said attaching portion being located so that a midportion of the connecting wire section engages a lengthwise wire at the juncture of said lengthwise wire with a crosswise wire in said deck and the parallel wire sections extend crosswise of the crosswise wire at positions in engagement with the underside of said crosswise wire on transversely opposite sides of said juncture, said upright yieldable portion comprising a pair of downwardly extending generally upright columns integral at their upper ends with said parallel spaced wire sections, first torsion bars corresponding to and spaced below said columns, second torsion bars at the lower ends of said columns, said second torsion bars extending transversely of said columns and parallel to said first torsion bars, downwardly inclined connecting bars corresponding to said columns and extending between the first and second torsion bars for each column, said connecting bars being inclined downwardly in opposite directions at positions beneath said attaching portion, and generally horizontal mounting feet integral with said first torsion bars and located beneath said attaching portion.

7. The box spring assembly according to claim 6 wherein said connecting wire section extends diagonally between said spaced wire sections and the underside of said diagonal connecting wire section at the mid portion thereof is formed with a notch into which said lengthwise wire extends and the underside of said crosswise wire is formed with notches into which said parallel wire sections project to maintain said parallel wire sections in fixed positions relative to said crosswise wire in a direction along the length thereof.

8. The method of assembling a box spring assembly which consists of the following components:

a. a rectangular generally horizontally disposed frame having side rails, end rails, and a plurality of cross rails that are generally parallel and are substantially perpendicular to said side rails;

b. a spring wire deck of generally horizontal shape and corresponding in size substantially to the size of said frame, said deck being in a generally horizontal position spaced a predetermined distance above said frame and including a plurality of cross wires that are directly above and substantially parallel to said cross rails, and lengthwise wires extending lengthwise of said frame at positions generally perpendicular to and overlapped with said cross wires; and c. a plurality of wire springs mounted on said cross rails and arranged in a supporting relation with said deck for yieldably supporting the deck on the frame, each of said springs including a vertically yieldable portion terminating at the upper end in a deck-attaching portion, each said deck-attaching portion including a pair of generally parallel spaced wire sections and a connecting wire section integral with and extending diagonally between said spaced wire sections, said method comprising the steps of:

positioning said springs on said cross rails and attaching said springs to said deck at the junctures of some of said cross wires with some of said lengthwise wires by:

i. first locating each said attaching portion so that a mid portion of the connecting wire section therein is engaged with the top side of the juncture of a lengthwise wire with a cross wire in said deck and the parallel wire sections are on opposite sides of the cross wire;

ii. subsequently rotating each said spring substantially about a vertical axis extending through said juncture to a position in which said parallel wire sections extend crosswise of the cross wire for said juncture at positions engaging the underside of said cross wire so that said parallel wire sections and said connecting wire section are located on opposite top and bottom sides of the deck wires at said juncture so as to clamp said spring to said deck; and iii. connecting said springs at the lower ends of said vertically yieldable portions to said cross rails.

9. The method of assembling a spring with the frame and the spring deck in a box spring assembly in which the frame is generally horizontal, the deck consists of a plurality of generally straight wires arranged criss-cross fashion in a horizontal plane located above the frame, and the spring consists of at least one vertically extending yieldable member supportable at its lower end on the frame and having at its upper end a generally horizontal attaching portion consisting of a pair of generally parallel spaced-apart wire sections and a connecting wire section integral with and extending diagonally between said spaced wire sections, said method comprising the steps of:

a. locating the attaching portion so that a mid portion of the connecting wire section therein is engaged with the top side of the juncture of a pair of intersecting wires in said deck, and said parallel wire sections are located in diagonally opposite ones of the four quadrants formed by said intersecting wires, b. rotating said attaching portion about a vertical axis extending approximately through said mid portion to a position in which said parallel wire sections extend under and are engaged with the underside of one of said intersecting wires to thereby effect a clamping of said attaching portion to said deck, and c. securing the lower end of said yieldable member to said frame.

10. The method according to claim 9 further including forming a notch in the underside of said mid portion of the connecting section and forming notches in the undersides of said intersecting wire at the points of engagement thereof with said parallel sections.

11. A limited deflection spring comprising a wire body having an upright yieldable portion, an attaching portion at the upper end of said upright portion, said attaching portion being substantially horizontal and including a pair of generally parallel spaced wire sections and a connecting wire section integral with and extending between said spaced wire sections, said parallel wire sections and said connecting wire section being substantially coplanar, said upright yieldable portion comprising a pair of downwardly extending generally upright columns integral at their upper ends with said parallel spaced wire sections, first torsion bars corresponding to and spaced below said columns, second torsion bars at the lower ends of said columns, said second torsion bars extending transversely of said columns and parallel to said first torsion bars, downwardly inclined connecting bars corresponding to said columns and extending between the first and second torsion bars for each column, said connecting bars being inclined downwardly in opposition directions at positions beneath said attaching portion, and generally horizontal mounting feet integral with said first torsion bars and located beneath said attaching portion.

* * * * *